US012441510B2

(12) United States Patent
Gu

(10) Patent No.: US 12,441,510 B2
(45) Date of Patent: Oct. 14, 2025

(54) FOLDING BASKET

(71) Applicant: Haidong Gu, Montclair, CA (US)

(72) Inventor: Haidong Gu, Montclair, CA (US)

(73) Assignee: CYCLINGDEAL USA, INC., CA (US)

( * ) Notice: Subject to any disclaimer, the term of this patent is extended or adjusted under 35 U.S.C. 154(b) by 19 days.

(21) Appl. No.: 18/593,994

(22) Filed: Mar. 4, 2024

(65) Prior Publication Data

US 2025/0276828 A1 Sep. 4, 2025

(51) Int. Cl.
*B65D 6/18* (2006.01)
*B65D 6/00* (2006.01)

(52) U.S. Cl.
CPC ..... *B65D 11/186* (2013.01); *B65D 11/10* (2013.01)

(58) Field of Classification Search
CPC . B65D 1/225; B65D 5/02; B65D 5/20; B65D 5/18; B65D 7/14; B65D 2313/00; B65D 11/186; B65D 11/10
See application file for complete search history.

(56) References Cited

U.S. PATENT DOCUMENTS 10,944,439 B2 * 3/2021 Liao ..... G06Q 10/08
2013/0001223 A1 * 1/2013 Cavalcante ..... B65D 88/52 220/660
2015/0114959 A1 * 4/2015 Fritz ..... B62B 1/12 220/7
2019/0300245 A1 * 10/2019 Wright ..... B65D 43/164

* cited by examiner

*Primary Examiner* — Kareen K Thomas

(57) ABSTRACT

A folding basket includes a bottom frame panel having a first bottom frame and a second bottom frame on each long and short sides. A first side frame panel is pivoted to the first bottom frame. A second side frame panel is pivoted to the second bottom frame. Two accommodating portions are horizontally recessed in an outer side of the first side frame panel. A locking member is horizontally and movably installed in each accommodating portion. Two ends of the locking members are respectively engaged with side edges of the first and second side frame panels. When the locking members are pulled, the locking relationship between the two ends of the locking members and the side edges of the first and second side frame panels is released, so that the first side frame panel and the second side frame panel are foldable inward sequentially.

11 Claims, 14 Drawing Sheets

FOLDING BASKET

FIELD OF THE INVENTION

The present invention relates to a basket, and more particularly, to a folding basket capable of installed to a bicycle rear rack.

BACKGROUND OF THE INVENTION

The conventional storage baskets are mostly one-piece molded and fixed in shape. When not containing items, this type of storage basket occupies a large volume due to its inability to fold, and may cause storage problems. In order to improve the above shortcomings, foldable storage baskets are also available on the market to meet different needs.

The present invention intends to provide a foldable basket to eliminate the shortcomings mentioned above.

SUMMARY OF THE INVENTION

The present invention relates to a folding basket and comprises a bottom frame panel which includes a first bottom frame on each long sides, and a second bottom frame on each short sides. Each first bottom frame has multiple first pivot connectors, and each second bottom frame has multiple second pivot connectors. A first side frame panel is pivoted to the first bottom frame. The first side frame panel has multiple first pivot parts located at a bottom thereof and corresponding to the multiple first pivot connectors. A second side frame panel is pivoted to the second bottom frame. The second side frame panel has multiple second pivot parts located at a bottom thereof and corresponding to the multiple second pivot connectors. Two accommodating portions are horizontally recessed in an outer side of the first side frame panel. A locking member is horizontally and movably installed in each accommodating portion. Two ends of the locking members are respectively engaged with side edges of the first side frame panel and the second side frame panel. When the locking members are pulled, the locking relationship between the two ends of the locking members and the side edges of the first side frame panel and the second side frame panel is released so that the first side frame panel and the second side frame panel are foldable inward sequentially.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
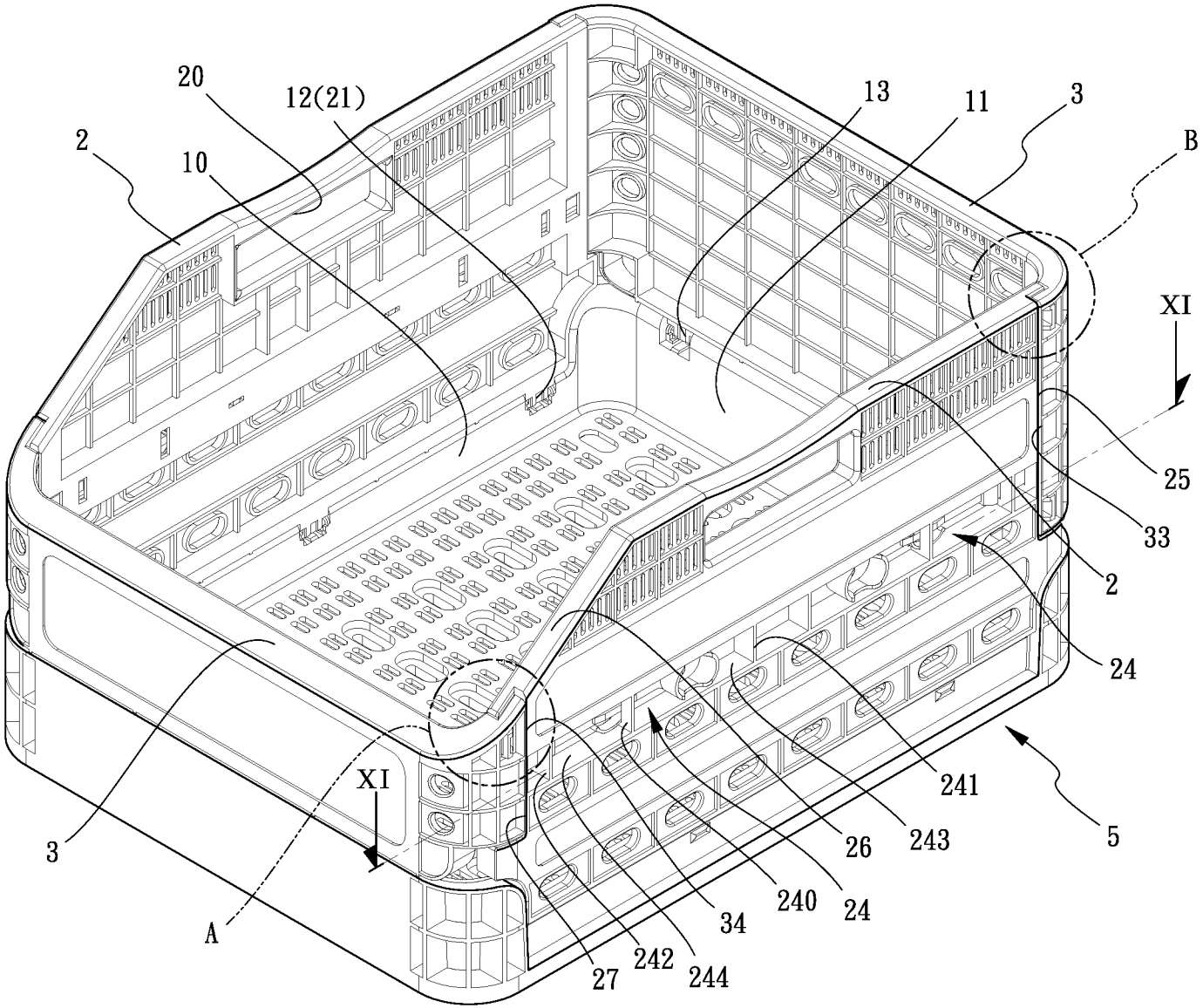
FIG. 1 is a perspective view of the folding basket of the present invention.
Figure 2:
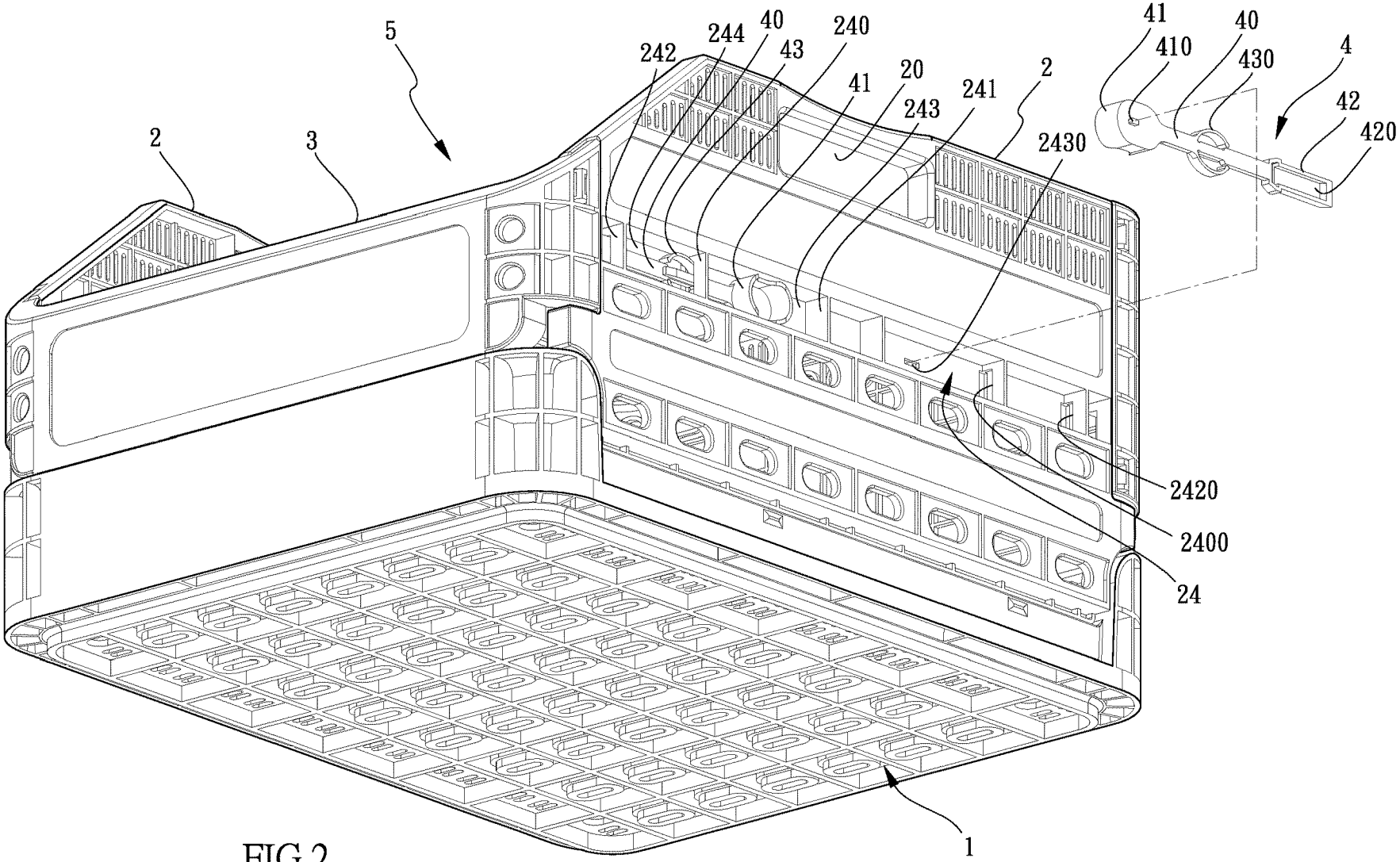
FIG. 2 is another perspective view of the folding basket of the present invention.

Referring to FIGS. 1 to 14, the folding basket 5 of the present invention comprises a bottom frame panel 1 having a first bottom frame 10 on each long sides, and a second bottom frame 11 on each short sides. Each first bottom frame 10 has multiple first pivot connectors 12, and each second bottom frame 11 has multiple second pivot connectors 13.

A first side frame panel 2 is pivoted to the first bottom frame 10. The first side frame panel 2 has multiple first pivot parts 21 located at a bottom thereof and corresponding to the multiple first pivot connectors 12. The first side frame panel 2 includes a gripping recess 20 for convenience of gripping the folding basket 5. The first side frame panel 2 has first engaging parts 22 and first receiving surfaces 23 at side edges thereof. Two accommodating portions 24 are horizontally recessed in an outer side of the first side frame panel 2. Each of the two accommodating portions 24 on the outer side of the first side frame panel 2 has a limiting plate 240, a first blocking plate 241 and a second blocking plate 242. A first storage space 243 is formed between the limiting plate 240 and the first blocking plate 241, and a second storage space 244 is formed between the limiting plate 240 and the second blocking plate 242. A positioning hole 2430 is defined in an inside wall of the first storage space 243. The limiting plate 240 has a first perforation 2400, and the second blocking plate 242 has a second perforation 2420. In this embodiment, one of two side end faces of the first side frame panel 2 is a first planar segment 25, and another one of the two side end faces slopes downward from the top to form an inclined surface segment 26, then extends downward to form a second planar segment 27.

A second side frame panel 3 is pivoted to the second bottom frame 11. The second side frame panel 3 has second engaging parts 31 which are located corresponding to the first engaging parts 22. The second side frame panel 3 also has a second receiving surfaces 32 which is adjacent to the first receiving surfaces 23. In this embodiment, both side end faces of the second side frame panel 3 have first bending segments 33 and second bending segments 34 corresponding to the first planar segment 25 and the second planar segment 27 of the first side frame panel 2 respectively.

A locking member 4 is horizontally and movably installed in each accommodating portion 24. Each of the locking members 4 has a rod body 40, a handle portion 41 and a locking portion 42 are respectively formed at both ends of the rod body 40. The handle portion 41 has a positioning part 410 facing the accommodating portion 24, and the locking portion 42 includes a hollow groove 420 facing the accommodating portion 24. An elastic limiting portion 43 is located between the handle portion 41 and the locking portion 42. The elastic limiting portion 43 of the locking member 4 has two elastic arc pieces 430 respectively set on upper and lower sides of the rod body 40.

Figure 3:
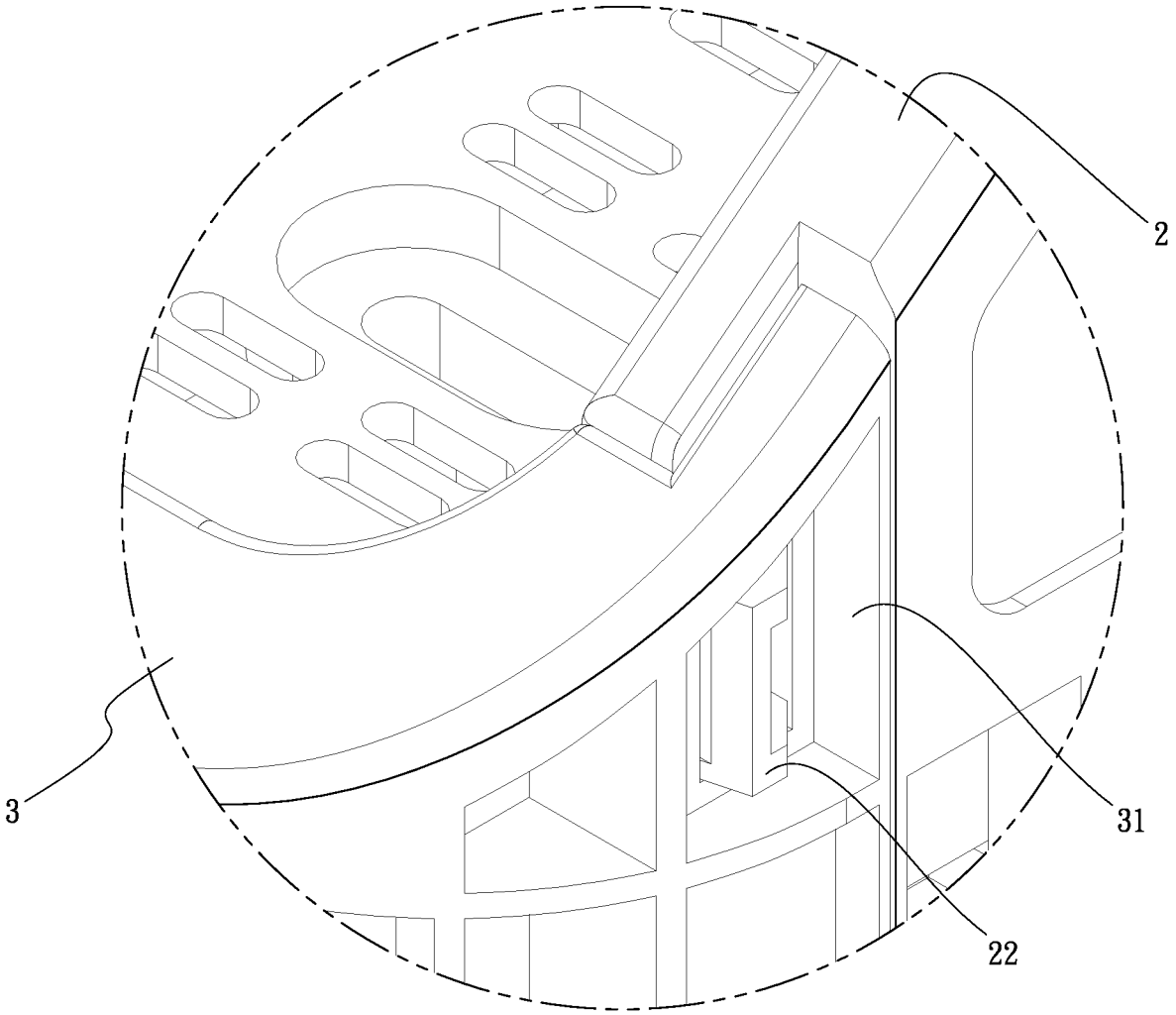
FIG. 3 is an enlarged view of the circled "A" of FIG. 1.
Figure 4:
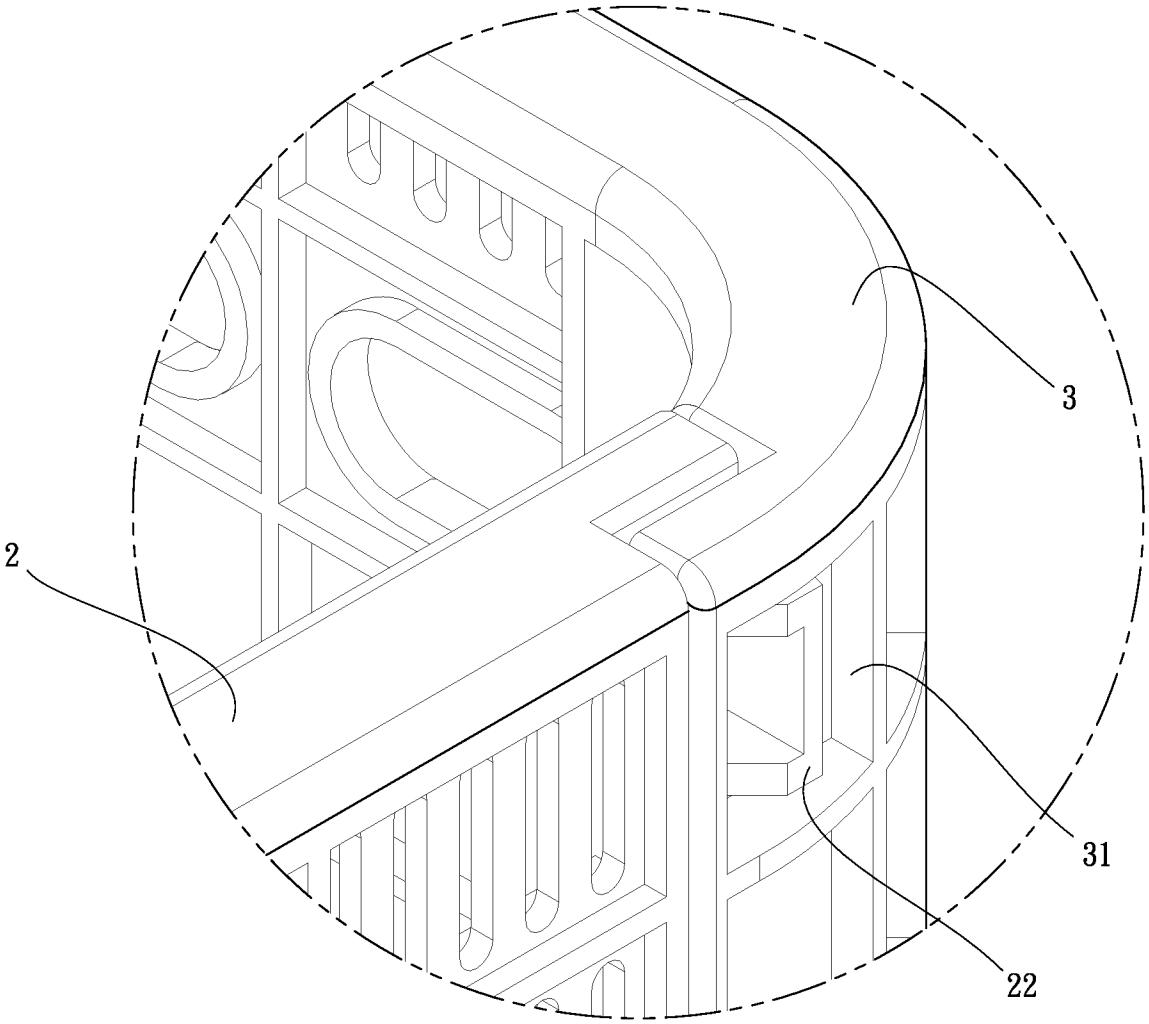
FIG. 4 is an enlarged view of the circled "B" of FIG. 1.
Figure 5:
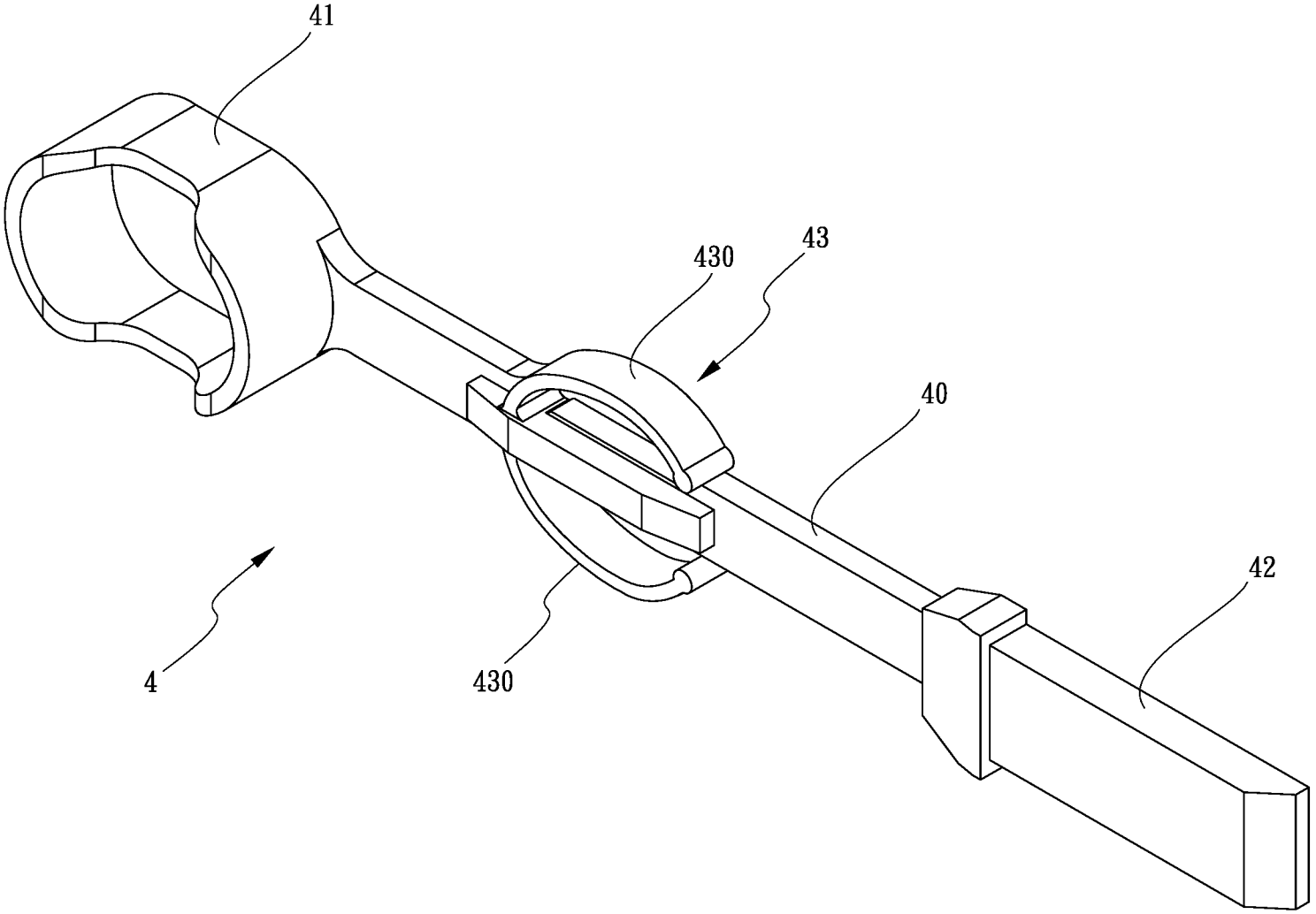
FIG. 5 is a perspective view of the locking member of the present invention.
Figure 6:
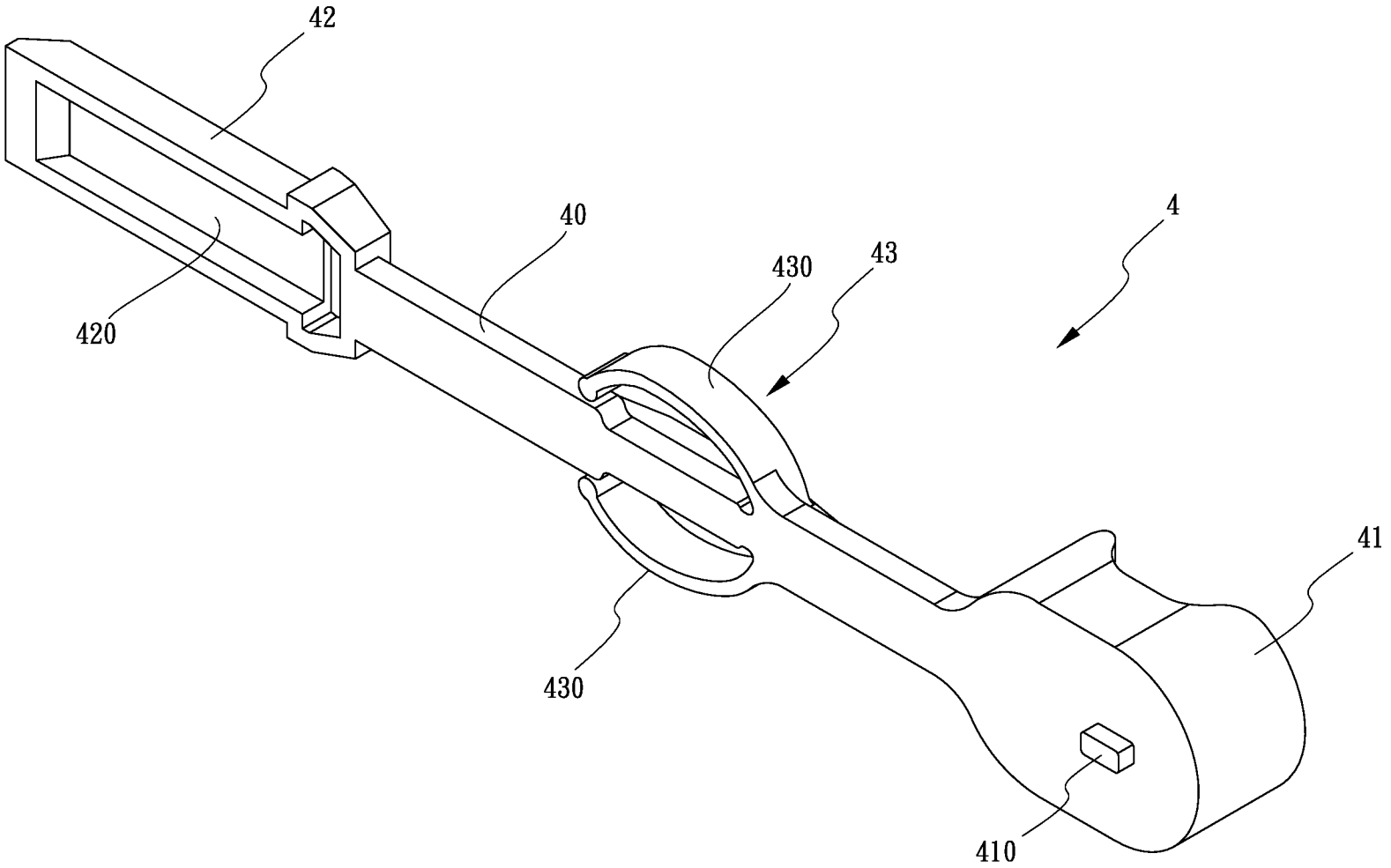
FIG. 6 is another perspective view of the locking member of the present invention.
Figure 7:
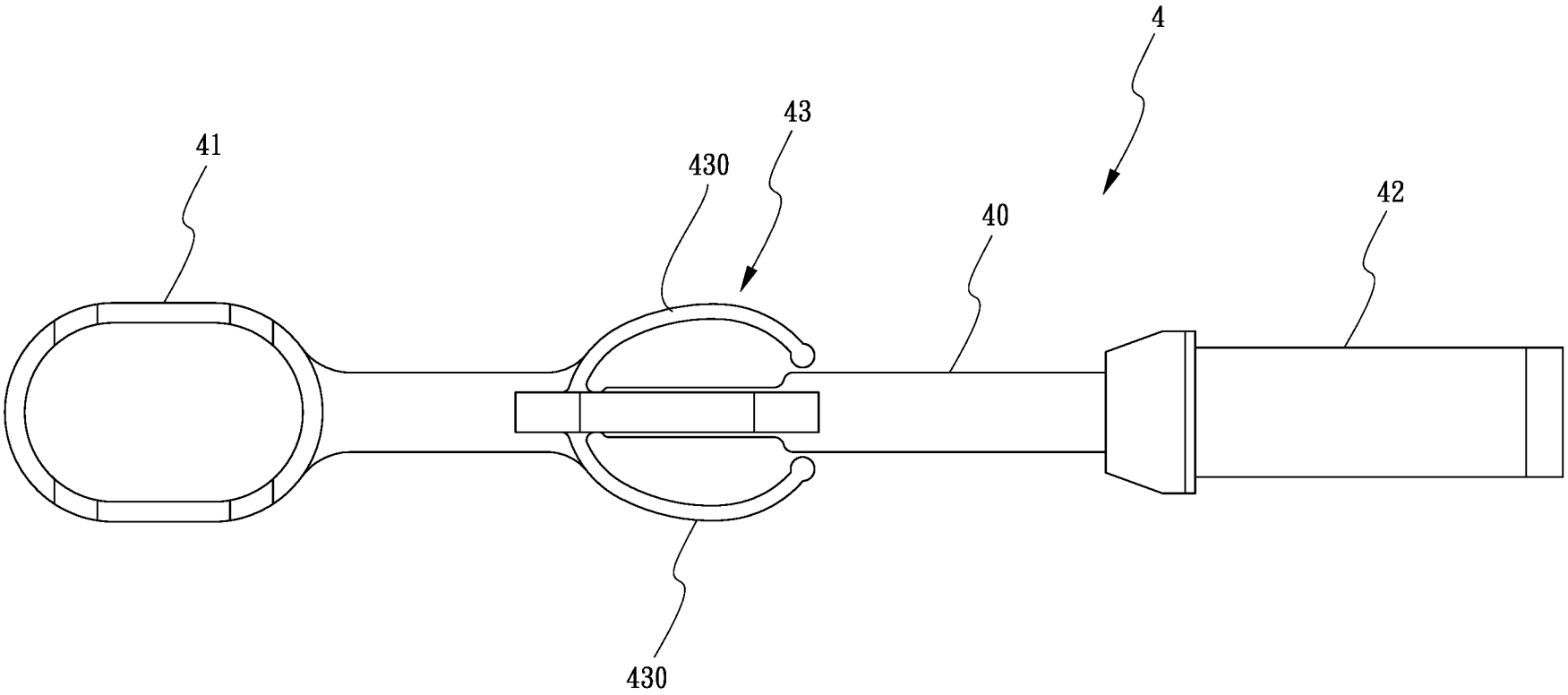
FIG. 7 is a plan view of the locking member of the present invention.

When assembling, the multiple first pivot parts 21 of the first side frame panel 2 and the multiple second pivot parts 30 of the second side frame panel 3 are respectively pivoted to the multiple first pivot connectors 12 of the first bottom frame 10 are respectively pivotably connected to the first pivot connectors 12 of the first bottom frame 10 and the second pivot connectors 13 of the second bottom frame 11. Accordingly, the first side frame panel 2 and the second side frame panel 3 can be fold inward toward the central position of the bottom frame panel 1. Since the first engaging part 22 of the first side frame panel 2 is connected to the second engaging part 31 of the second side frame panel 3 from the inner side of the second side frame panel 3 to the outer side of the second side frame panel 3 (as shown in FIGS. 3 and 4), so that the second side frame panel 3 must be folded after the first side frame panel 2 is folded inward.

Subsequently, the rod body 40 extends through the first perforation 2400 of the limiting plate 240, causing the elastic limiting portion 43 to be constrained by the limiting plate 240 in the second storage space 244. Meanwhile, the handle portion 41 is positioned in the first storage space 243, which has positioning holes 2430 corresponding to the positioning parts 410 of the handle portion 41. The positioning relationship between the positioning parts 410 and the positioning holes 2430 enhances the stability of the handle portion 41 in the first storage space 243. The locking portion 42 passes through the second perforation 2420 of the second blocking plate 242 and forms a locking relationship with the first receiving surface 23 of the first side frame panel 2 and the second receiving surface 32 of the second side frame panel 3.

Figure 8:
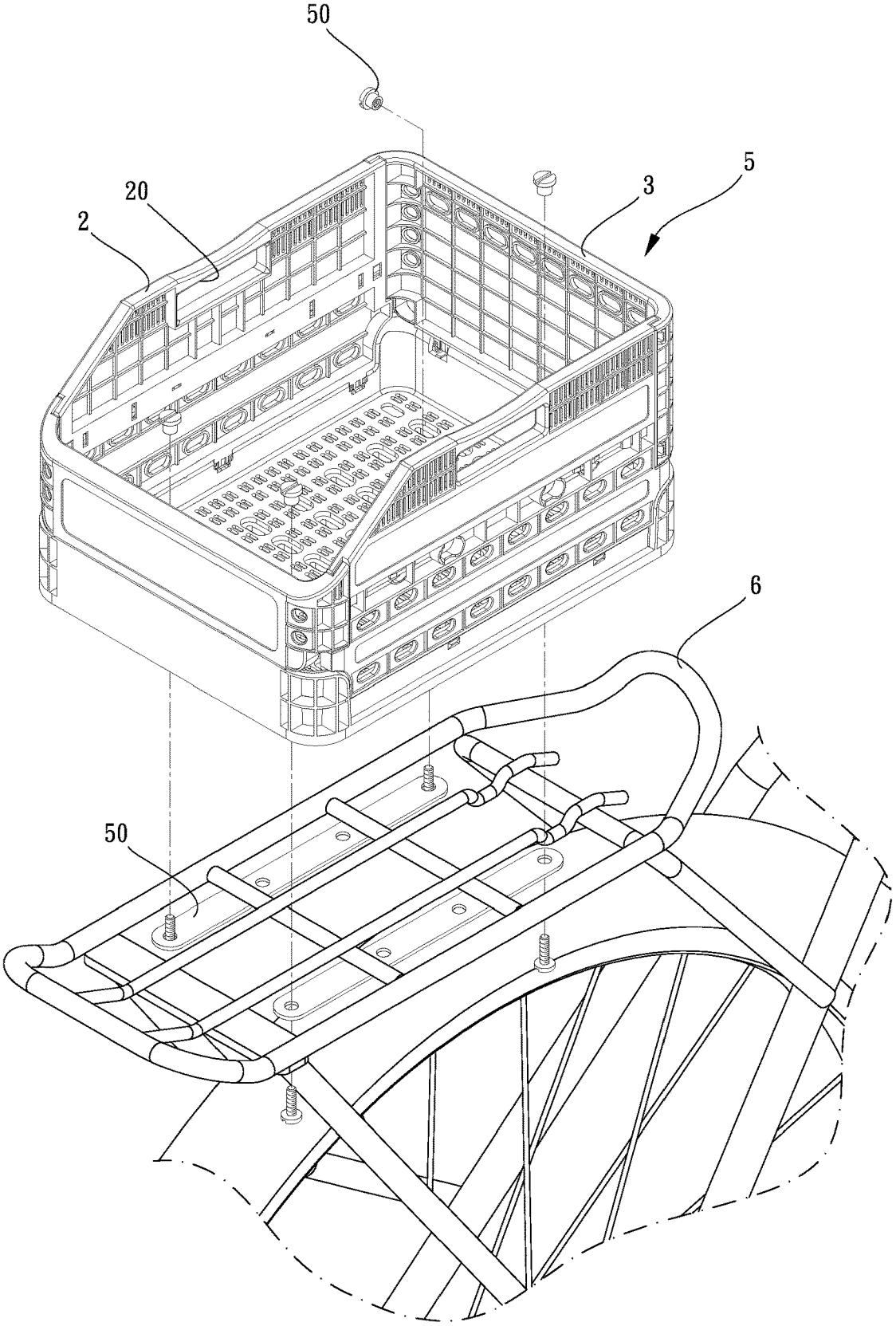
FIG. 8 is a schematic diagram to show that the folding basket is installed on a bicycle rear rack.
Figure 9:
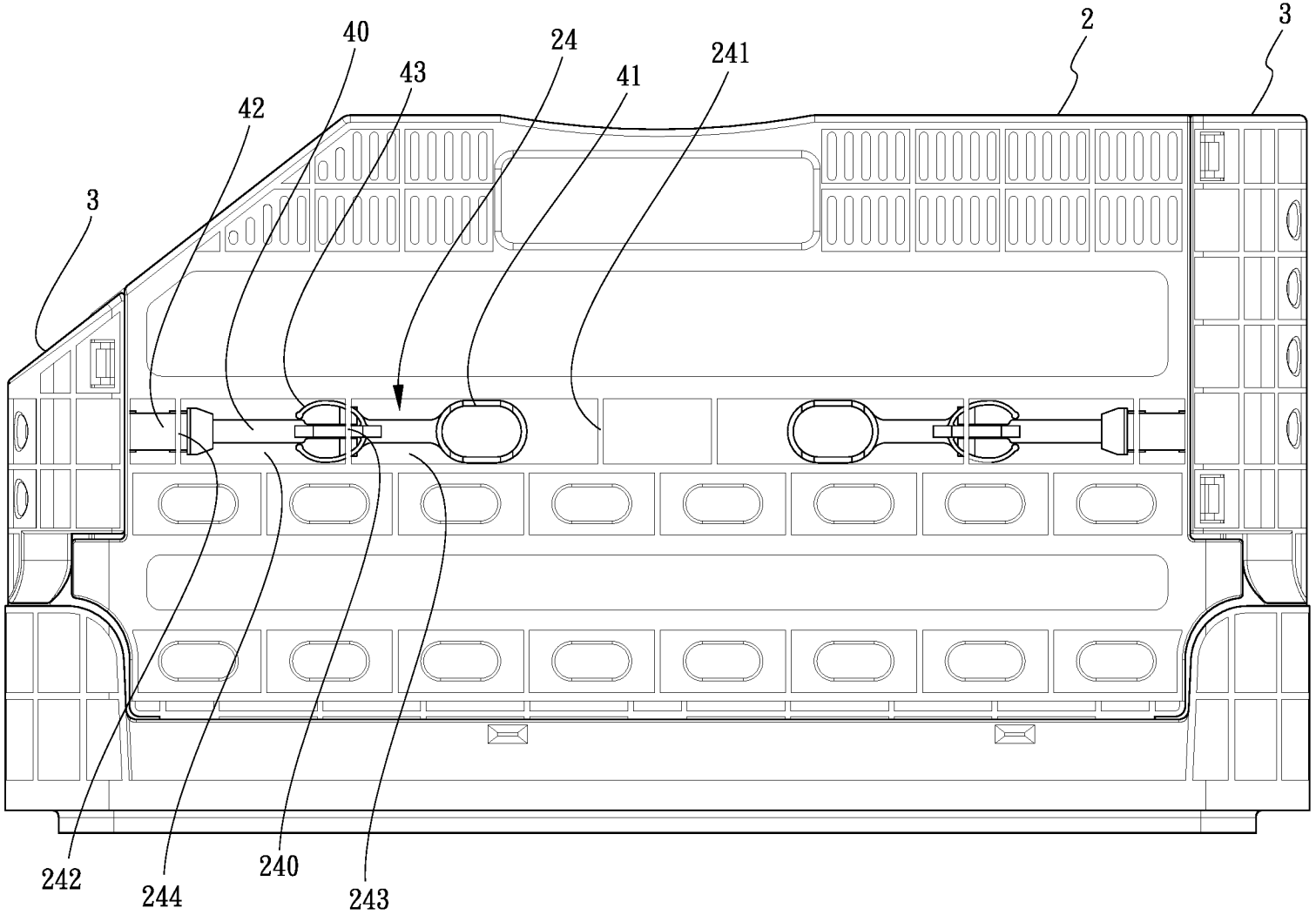
FIG. 9 is a side view plan of the action of the locking member of the present invention.
Figure 10:
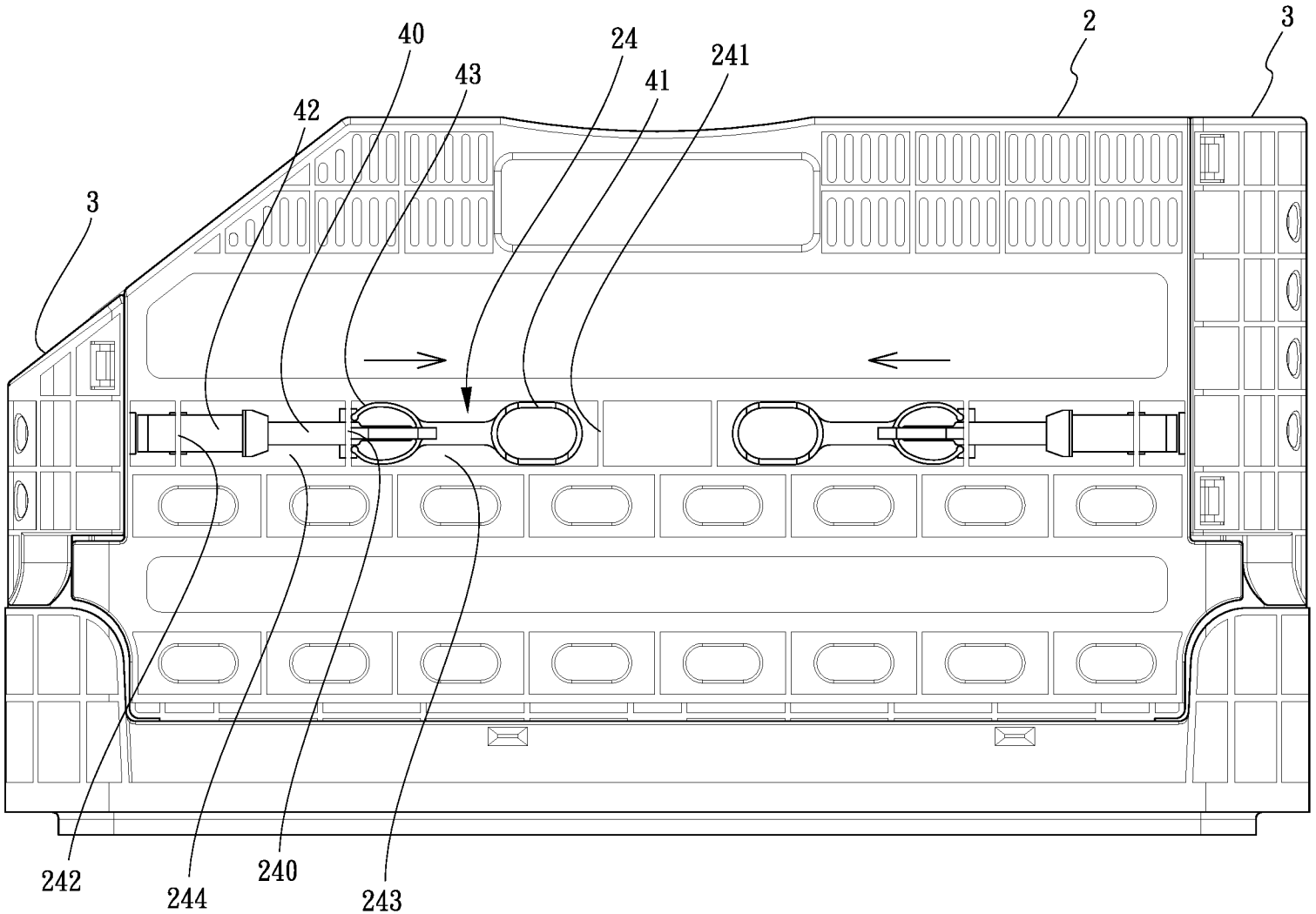
FIG. 10 is another side view plan of the action of the locking member of the present invention.
Figure 11:
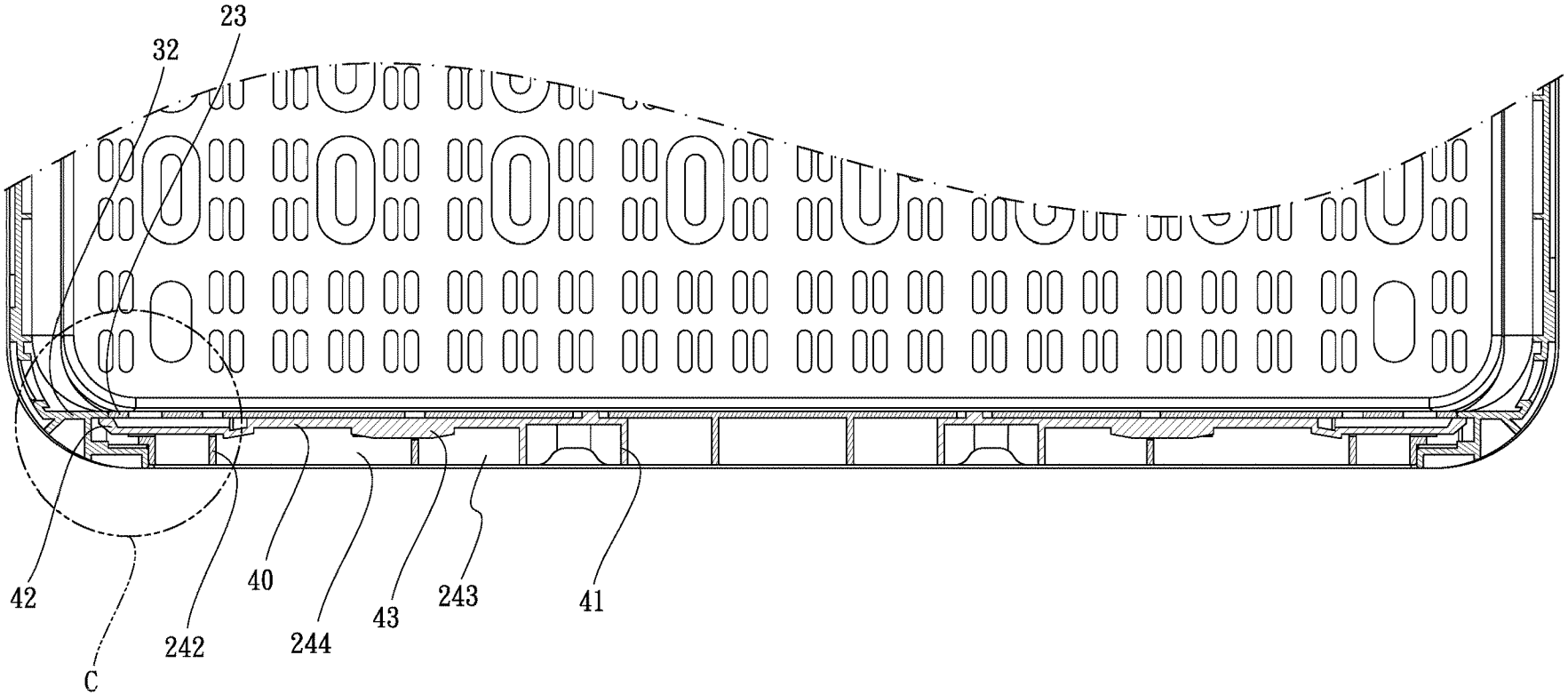
FIG. 11 is a sectional view, taken along line VIII-VIII of FIG. 1.
Figure 12:
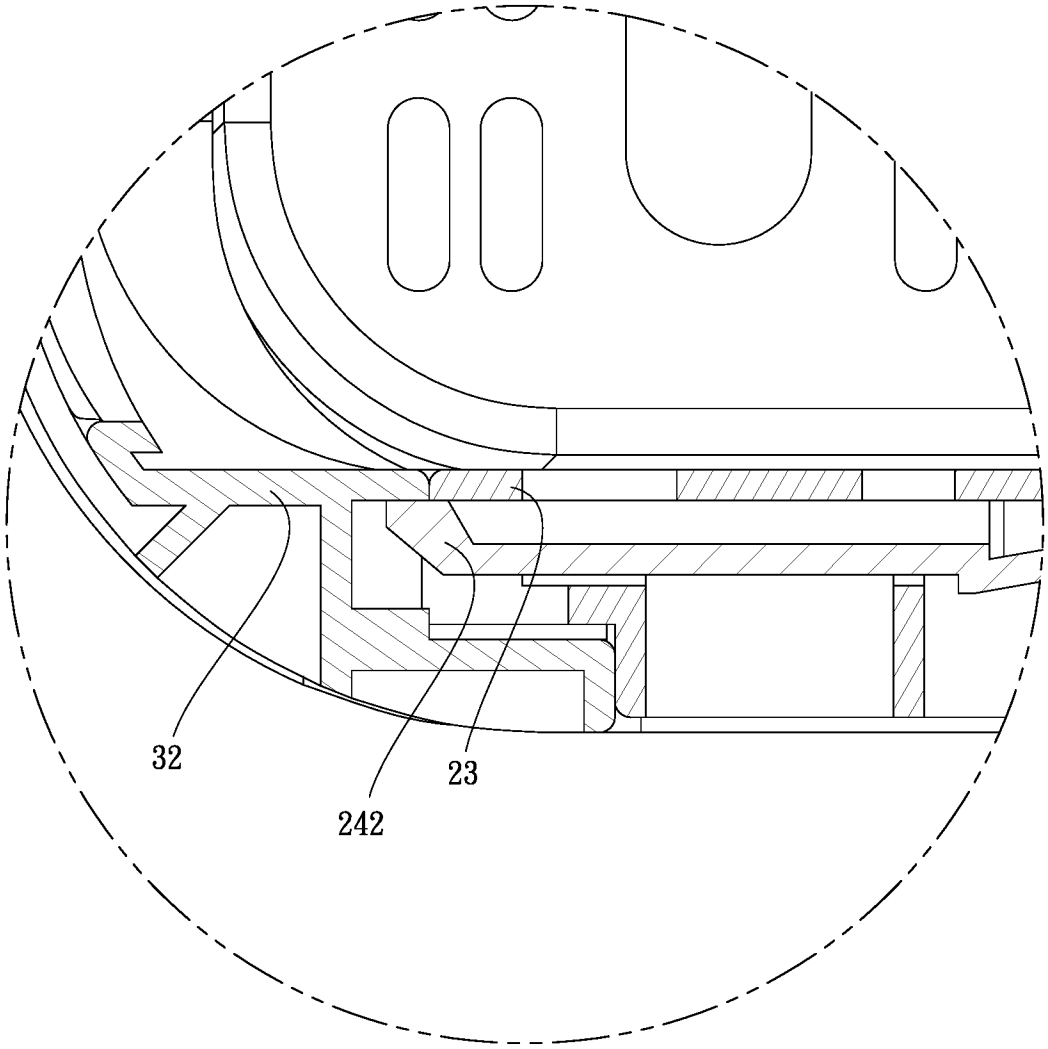
FIG. 12 is an enlarged view of the circled "C" of FIG. 11 of the present invention.
Figure 13:
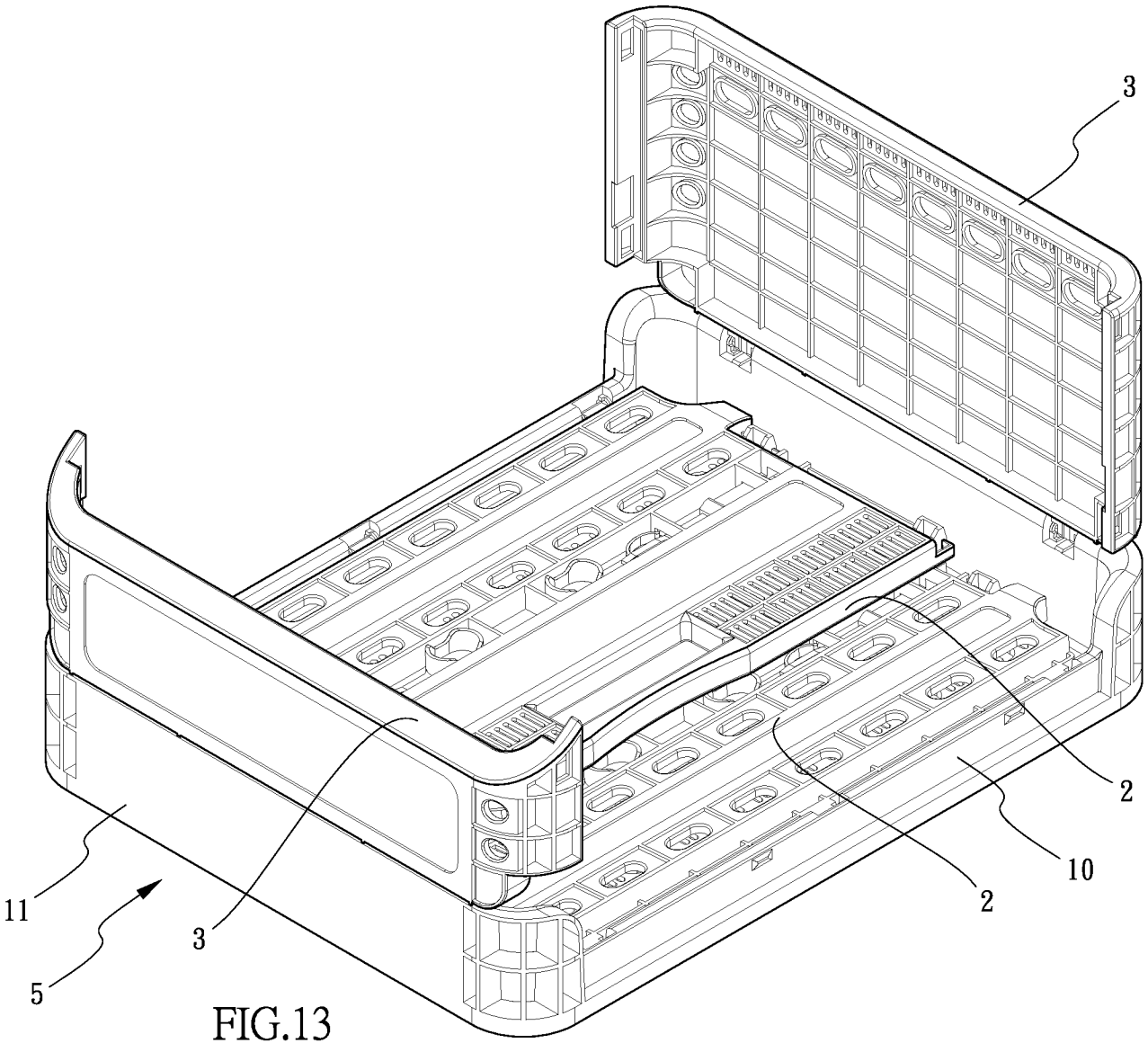
FIG. 13 is a schematic diagram to show the folding of the first side frame panel of the present invention.
Figure 14:
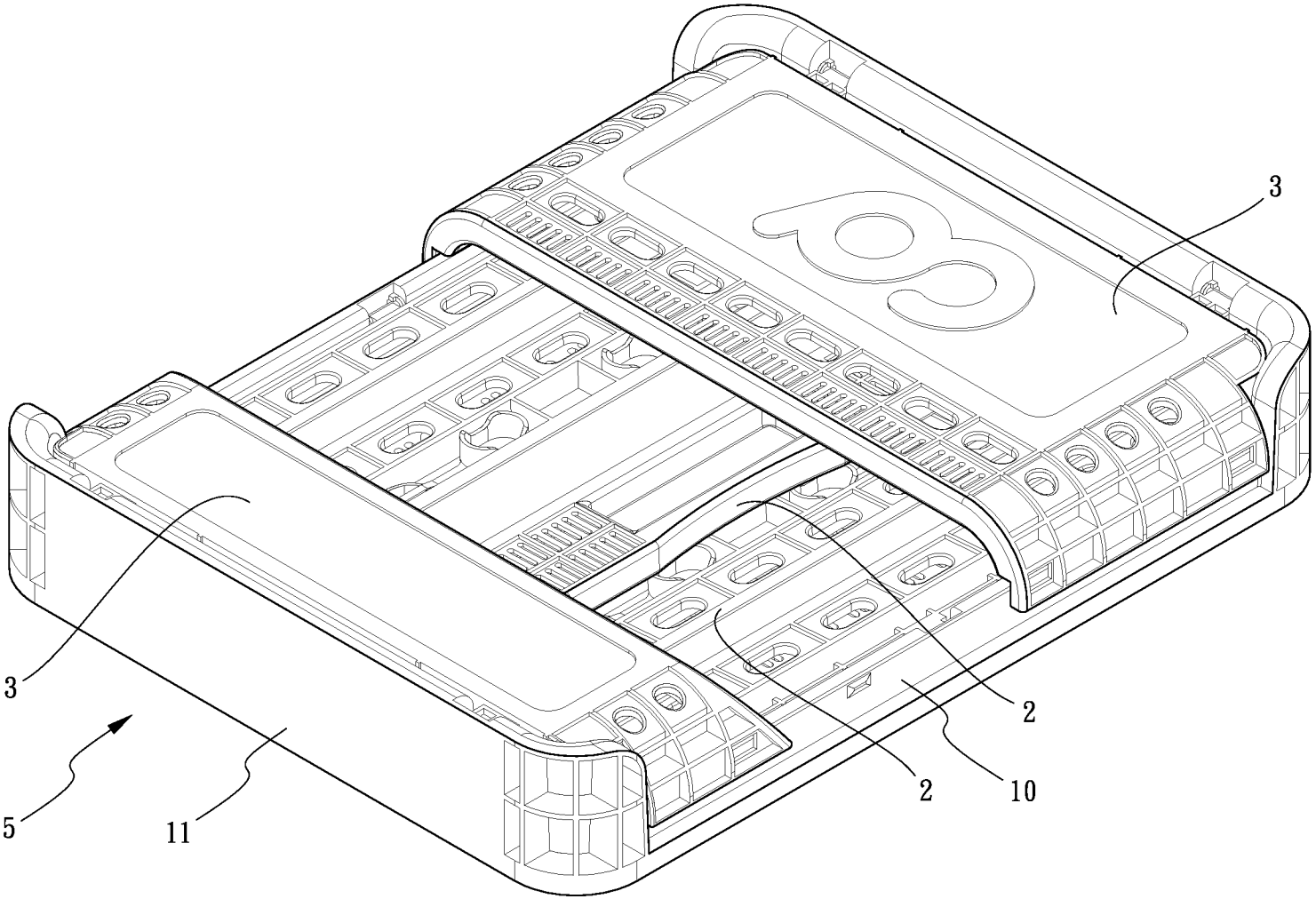
FIG. 14 is a schematic diagram to show the folding of the second side frame panel of the present invention.

When in use, as shown in FIGS. 8 and 14, the folding basket 5 of the present invention is mounted on a bicycle rear rack 6 by using assembly components 50, and items are placed inside the folding basket 5. The gripping recesses 20 of the first side frame panel 2 facilitate users in moving the folding basket 5. When the folding basket 5 does not need to hold items, users can laterally pull the locking member 4 (as shown in FIGS. 9 and 10). During the process of the rod body 40 passing through the first perforation 2400 of the limiting plate 240, the two elastic arc pieces 430 on the upper and lower sides of the rod body 40 are compressed elastically. After passing through the first perforation 2400, the two elastic arc pieces 430 are limited in the first storage space 243 due to elastic recovery. At the same time, after the locking portion 42 of the rod body 40 passes through the second perforation 2420 of the second blocking plate 242, the locking relationship between the locking portion 42 and the first receiving surface 23 of the first side frame panel 2 and the second receiving surface 32 of the second side frame panel 3 can be released. Subsequently, the first side frame panel 2 is folded inward (as shown in FIG. 13), and after the first side frame panel 2 is folded inward, the engagement relationship between the first engaging part 22 of the first side frame panel 2 and the second engaging part 31 of the second side frame panel 3 is released, allowing the second side frame panel 3 to be folded inward (as shown in FIG. 14). In other words, by controlling whether the locking member 4 is pulled, the locking relationship between the locking member 4 and the first side frame panel 2 and the second side frame panel 3 is established or released, achieving the sequential inward folding of the first side frame panel 2 and the second side frame panel 3, completing the storage action.

It is noted that the locking member 4 has a hollow groove 420 facing the accommodating portion 24, which allows for a gap between the locking member 4 and the accommodating portion 24, avoiding excessive tightness and friction in the connection between them and improving the smoothness of pulling the locking member 4.

While we have shown and described the embodiment in accordance with the present invention, it should be clear to those skilled in the art that further embodiments may be made without departing from the scope of the present invention.

What is claimed is:

1. A folding basket (5) comprises:

a bottom frame panel (1) having a first bottom frame (10) on each long sides, and a second bottom frame (11) on each short sides, each first bottom frame (10) having multiple first pivot connectors (12), each second bottom frame (11) having multiple second pivot connectors (13);

a first side frame panel (2) pivoted to the first bottom frame (10), the first side frame panel (2) having multiple first pivot parts (21) located at a bottom thereof and corresponding to the multiple first pivot connectors (12);

a second side frame panel (3) pivoted to the second bottom frame (11), the second side frame panel (3) having multiple second pivot parts (30) located at a bottom thereof and corresponding to the multiple second pivot connectors (13), wherein two accommodating portions (24) are horizontally recessed in an outer side of the first side frame panel (2), a locking member (4) is horizontally and movably installed in each of the two accommodating portions (24), two ends of the locking members (4) are respectively engaged with side edges of the first side frame panel (2) and the second side frame panel (3), when the locking members (4) are pulled, the locking relationship between the two ends of the locking members (4) and the side edges of the first side frame panel (2) and the second side frame panel (3) is released so that the first side frame panel (2) and the second side frame panel (3) are foldable inward sequentially.

2. The folding basket as claimed in claim 1, wherein the side edges of the first side frame panel (2) have first engaging parts (22), the second side frame panel (3) has second engaging parts (31) which are located corresponding to the first engaging parts (22).

3. The folding basket as claimed in claim 1, wherein each of the two accommodating portions (24) on the outer side of the first side frame panel (2) has a limiting plate (240), a first blocking plate (241) and a second blocking plate (242), a first storage space (243) is formed between the limiting plate (240) and the first blocking plate (241), a second storage space (244) is formed between the limiting plate (240) and the second blocking plate (242), the limiting plate (240) has a first perforation (2400), the second blocking plate (242) has a second perforation (2420).

4. The folding basket as claimed in claim 3, wherein the side edges of the first side frame panel (2) has first receiving surfaces (23), the second side frame panel (3) has a second receiving surfaces (32) which is adjacent to the first receiving surfaces (23), each of the locking members (4) has a rod body (40), a handle portion (41) and a locking portion (42) are formed at both ends of the rod body (40), an elastic limiting portion (43) is located between the handle portion (41) and each of the locking portions (42), the handle portion (41) is located in the first storage space (243) corresponding thereto, the elastic limiting portion (43) is located in the second storage space (244) corresponding thereto, the locking portions (42) are engaged with the first receiving surfaces (23) and the second receiving surfaces (32) respectively to form a locking relationship.

5. The folding basket as claimed in claim 4, wherein the elastic limiting portion (43) of the locking member (4) has two elastic arc pieces (430) respectively set on upper and lower sides of the rod body (40).

6. The folding basket as claimed in claim 4, wherein the handle portion (41) has a positioning part (410) which is located corresponding to a positioning hole (2430) defined in an inside wall of the first storage space (243).

7. The folding basket as claimed in claim 4, wherein each of the locking portions (42) includes a hollow groove (420) facing the accommodating portion (24), the hollow groove (420) avoids friction between the locking member (4) and the accommodating portion (24) to improve smoothness of pulling the locking member (4).

8. The folding basket as claimed in claim 1, wherein one of two side end faces of the first side frame panel (2) is a first planar segment (25), another one of the two side end faces slopes downward from the top to form an inclined surface segment (26), then extends downward to form a second planar segment (27).

9. The folding basket as claimed in claim 7, wherein both side end faces of the second side frame panel (3) have first bending segments (33) and second bending segments (34) corresponding to the first planar segment (25) and the second planar segment (27) of the first side frame panel (2) respectively.

10. The folding basket as claimed in claim 1, wherein the first side frame panel (2) has a gripping recess (20).

11. The folding basket as claimed in claim 1, wherein the folding basket (5) is mounted on a bicycle rear rack (6) using assembly components (50).

* * * * *